US005899403A

United States Patent [19]

Gietman, Jr. et al.

[11] Patent Number: 5,899,403

[45] Date of Patent: May 4, 1999

[54] METHOD AND APPARATUS FOR WINDING BAGS ONTO A SPINDLE

[75] Inventors: Peter J. Gietman, Jr., Combined Locks; Thomas C. Jansen, Appleton; Christopher A. Saucier, Kaukauna, all of Wis.

[73] Assignee: CMD Corporation, Appleton, Wis.

[21] Appl. No.: 08/662,311

[22] Filed: Jun. 13, 1996

Related U.S. Application Data

[63] Continuation of application No. 08/248,400, May 24, 1994, abandoned.

[51] Int. Cl.[6] ..... B65H 39/14

[52] U.S. Cl. ..... 242/528; 242/532.2

[58] Field of Search ..... 242/528, 532.2

[56] References Cited

U.S. PATENT DOCUMENTS 4,456,190 6/1984 Karttunen et al. .
4,567,984 2/1986 Gietman .
4,601,441 7/1986 Oininen et al. .
4,642,084 2/1987 Gietman .
4,667,890 5/1987 Gietman .
4,695,005 9/1987 Gietman .
4,934,993 6/1990 Gietman .
5,318,237 6/1994 Lotto et al. .

*Primary Examiner*—Donald P. Walsh
*Assistant Examiner*—Emmanuel M. Marcelo
*Attorney, Agent, or Firm*—George R. Corrigan

[57] ABSTRACT

A method and apparatus for winding film includes guiding a strip of the film through a winding machine to a rotating spindle. At least one deflector and/or at least one source of air, such as a nozzle, is moved to the path of the film downstream from the spindle, and an airhorn is moved to the spindle. The leading edge of the strip is directed into the airhorn by the deflector and/or air from the nozzle, and then directed by air within the airhorn into its own nip. Finally, the strip is wound about the spindle.

29 Claims, 2 Drawing Sheets

METHOD AND APPARATUS FOR WINDING BAGS ONTO A SPINDLE

This application is a continuation of application Ser. No. 08/248,400, filed May 24, 1994, entitled, Method and Apparatus For Winding Bags, now abandoned.

FIELD OF THE INVENTION

The present invention relates generally to the art of winding equipment. More specifically, it relates to equipment for winding strips of elongate, pliable material, such as paper or plastic, into core or coreless rolls.

BACKGROUND OF THE INVENTION

Equipment for winding material into core and coreless rolls is known in the art. For purposes of illustrating such prior art, one particular type of coreless plastic bag winder will be described, i.e., a winder for plastic garbage or trash bags, kitchen bags, wastebasket liners, food storage bags, etc.

In such a prior art winder, a continuous strip of bags is fed to the winder, and the winder prepares coreless rolls therefrom. The bags themselves are produced in upstream bag making equipment or on a separate piece of equipment, from which a continuous strip of bags is produced.

In most conventional bag making equipment a tube of plastic film is extruded through an extruding die, and the tube is then flattened before it enters the bag machine. In the bag machine the film is sealed across its width to form the bottom of the finished product. The open top of the bag can be formed in different ways. For example, the bag can simply be cut. In this type of bag machine, individual bags are formed which are typically folded and placed into suitable packaging for the individual or institutional consumer. In the other type of bag machine, the top is formed by perforating the bag across its width. The bag may then be folded longitudinally, either before or after the perforation step, to provide a continuous strip of connected and folded bags. Such bags are then wound into a core or coreless roll.

One prior art winder has been sold by CMD Corporation of Little Chute, Wis., the assignee of the present invention. Such winder includes a dancer mechanism to sense the tension of the strip of bags being fed to the winder. The dancer mechanism includes a connection to the winder drive motor, wherein the speed of the winder can be "slaved" to the output speed of an upstream bag making equipment.

The prior art winder also includes haul-off nip rollers, to feed the strip into the winder, and an interrupt section to periodically break the perforations between certain bags in the strip. The frequency of the interruption is determined by the number of bags to be included in each roll. For example, if the roll is to contain twenty bags, the interrupt section will break every twentieth perforation.

Downstream of these sections, the prior art winder includes a turret assembly with three spindles mounted 120° apart. To begin winding a roll of bags the leading end of one strip of bags is directed to a first spindle when the turret is in a transfer position. After the bag is secured to the spindle by a transfer mechanism such as that described in U.S. Pat. No. 4,667,890, incorporated herein by reference, the turret is rotated 120° so that the first spindle is in a winding position and the strip is wound into a coreless roll. Following completion of the roll winding, the turret rotates again to a removal station where the roll is pushed off the first spindle by a push-off palm for subsequent packaging. When the winding of the one roll is completed the leading end of the film is directed to a second spindle in the transfer position.

In some prior art winders the spindles of the machine are tapered and include a plurality of air holes through which air can be selectively injected. The taper and air injection assist in the removal of the coreless roll. Second, a belt is provided below the film path. The roll being wound on the spindle stays in contact with the belt to improve the quality of the rolled product, and as the diameter of the roll increases during winding, the belt moves to accommodate roll expansion. This bottom belt is just one of a series of bottom belts used in the prior art machine from the inlet to the outlet of the winder.

To attach the leading end of a strip to the spindle in the transfer position prior art machines use an airhorn and kick-roll mechanism. The kick-roll is a pneumatic activated roller located beneath a traveling belt at the area near the transfer location. At the time of transfer, the roller would be extended by a piston rod to quickly push against the belt to "flip" the leading edge of the strip of bags up into the air above the lower belt. At the same time, an airhorn would descend around the spindle, the airhorn being a half-cylinder containing air ports on one edge. The combination would direct the leading edge of the bag strip around the spindle and tuck it into its own nip to create the attachment. This system, while being better than earlier systems, suffers from drawbacks including ineffective transfers, such as a failure of the leading edge to tuck into its own nip. Because of the high speeds utilized in winders if the airhorn and kick-roll system failed to properly attach the moving plastic web to the spindle, a great deal of waste would occur before the next strip would arrive at the transfer position.

A winder which economically and effectively transferred a leading edge of a strip of plastic to a spindle would represent a significant advance in the art.

SUMMARY OF THE PRESENT INVENTION

According to one aspect of the invention a method for winding film includes guiding a strip of the film through a winding machine to a rotating spindle. At least one deflector is moved into the path of the film downstream from the spindle, and an airhorn is moved to the spindle. The leading edge of the strip is directed into the airhorn by the deflector and then directed into its own nip. Finally, the strip is wound about the spindle.

According to a second aspect of the invention a method for winding film includes guiding a strip of the film through a winding machine to a rotating spindle. A source of air, such as at least one nozzle is moved to blow air into the path of the film downstream from the spindle, and an airhorn is moved to the spindle. The leading edge of the strip is directed into the airhorn by the air and then directed into its own nip. Finally, the strip is wound about the spindle.

According to a third aspect of the invention a film winder includes a pair of haul-in rolls and a rotatable spindle. At least one deflector or a source of air, such as at least one air nozzle, is mounted on a movable arm, that allows the deflector or air nozzle to be moved to the path of the film, downstream from the spindle. An airhorn, is provided and is movable to be disposed over the spindle. The strip is deflected into the airhorn by the deflector or air from the nozzle. A source of air in the airhorn directs the leading edge of the strip into its own nip.

Other principal features and advantages of the invention will become apparent to those skilled in the art upon review of the following drawings, the detailed description and the appended claims.

Figure 1:
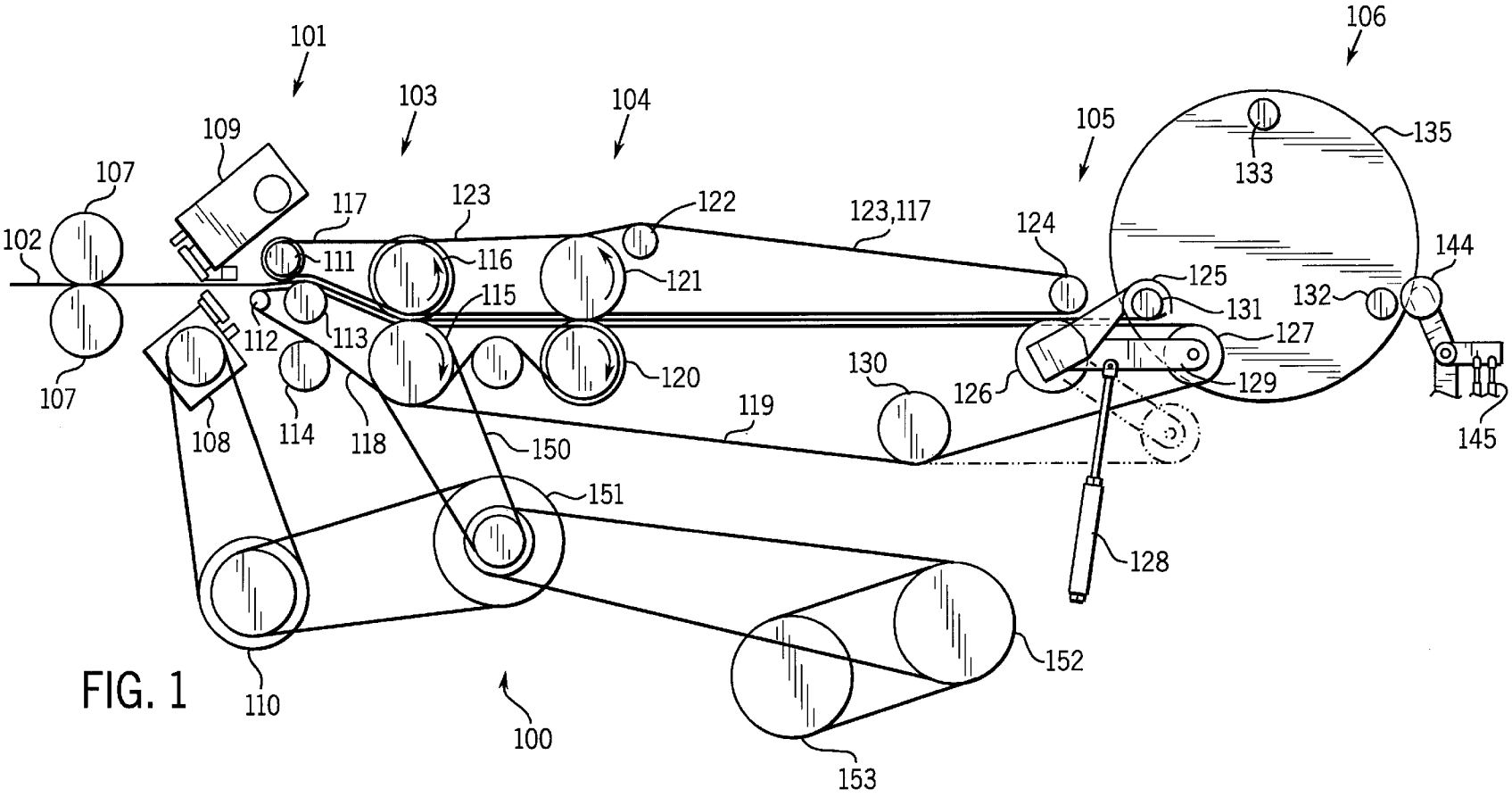
FIG. 1 is a schematic of a winder constructed in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to its use as a winder for strips of plastic bags, it should be understood at the outset that the winder can also be employed for winding other pliable materials, such as paper or plastic sheets. The material being wound should have sufficient tear strength to be able to withstand the winding forces imposed at the transfer and surface-wind stations. For example, plastic sheeting, paper and tissue products and the like could be wound using the winder of the present invention after appropriate modification, which would be readily apparent to one skilled in the art after reading the present disclosure.

Referring now to FIG. 1, a winder 100 constructed in accordance with the present invention is shown schematically. Winder 100 winds a film 102 and includes, in one embodiment, a knife assembly 101 for cutting the film, a haul-in roll nip section 103, an interrupt nip section 104, a transfer assembly 105 and a turret assembly 106.

Plastic film 102 is received by winder 100 upstream of knife assembly 101 at a nip formed by driven rolls 107. Plastic film 102 may be a continuous strip of plastic or plastic bags with perforations separating the bags and may by provided from a large roll or directly from a bag making machine. If the film is provided directly from a bag making machine then the winder speed may be slaved to the bag making machine speed, for example, by using known techniques such as dancer rolls.

If plastic film 102 is to be wound into rolls having continuous strips (rather than bags) then knife assembly 101 is used to cut film 102 to create the end of a first roll and the beginning of a subsequent roll. Knife assembly 101 includes a rotating knife 108 and a cam-driven knife 109. Rotary knife 108 is driven by a jack shaft 110 and continuously rotates at a speed corresponding to the speed of the winder. When plastic film 102 is to be cut, a cam associated with knife 109 rotates, causing knife 109 to move downward toward film 102. The timing of the cam is synchronized such that knife 109 meets knife 108 at film 102, thereby cutting film 102 and creating a strip of the desired length. As one skilled in the art should recognize, other cutting apparatus may be implemented.

Film 102 then travels to haul-in nip section 103, comprised of rolls 115 and 116. Haul-in nip section 103 includes a plurality of top ropes 117 and bottom ropes 118 that guide film 102 as it passes through haul-in nip section 103. Ropes 117 form an endless loop around roll 111 and a roll 124. Freewheeling roll 111 has grooves disposed about its circumference to receive ropes 117 therein. Haul-in roll 116 is driven and has grooves about its circumference in which ropes 117 are disposed so that ropes 117 are driven by roll 116.

Working in conjunction with top ropes 117 are bottom ropes 118 and their associated rolls. Ropes 118 form an endless loop around rolls 112 and 115. Roll 112 is a straight surface roll wherein ropes 118 band around its surface. Roll 113 has grooves therein, through which ropes 118 pass. Ropes 118 are driven by grooved roll 115.

Film 102 generally rests on the top of ropes 118 and passes under ropes 117. Thus, film 102 is guided and driven by ropes 117 and 118 into the haul-in nip section. Roll 115 is driven by a gear belt 150 and a jack shaft 151, that also drives jack shaft 110. Jack shaft 151 is driven by a jack shaft 152 and a motor and gear box 153.

A second plurality of top ropes 123 form an endless loop around roll 116 and roll 124. Similarly, a second plurality of bottom ropes 119 form an endless loop around roll 115 and a kick roll 127. Ropes 117, 119 and 123 guide film 102 downstream to an interrupt section 104. Interrupt section 104 includes a pair of rolls 121 and 120. Top ropes 117 and 123 extend through grooves in roll 121 that are large enough that ropes 117 and 123 do not drive, nor are ropes 117 and 123 significantly impeded by, roll 121. Ropes 123 are also disposed in circumferential grooves of haul-in roll 116. The circumferential grooves that ropes 123 are disposed on roll 116 are offset from the grooves in which ropes 117 are disposed. Roll 122 is a rope idler roll for ropes 117 and 123.

Roll 120 is disposed below and in alignment with roll 121. Roll 120 has circumferential grooves to allow ropes 119 to pass through freely. Thus, ropes 119 are not driven by roll 120. Roll 120 is driven via a belt and tensioner from roll 115 at a speed where the surface speed of the roll 120 is approximately 15 to 17 percent faster than the film speed.

Top interrupt roll 121 is driven from roll 120 by a set of gears. By appropriate control, roll 121 is periodically lowered and comes into contact with moving film 102. The differential surface speed between rollers in section 103 and section 104 causes a tear of the perforations connecting two bags.

Continuing downstream, ropes 117, 123 and 119 guide film 102 to transfer assembly 105. As shown in FIG. 1, transfer assembly 105 includes rope return roll 124, an airhorn 125, a rope roll 126 and kick roll 127 mounted on an arm 129, and an air cylinder 128. As will be described in greater detail below, air cylinder 128 moves arm 129 and roll 127 from a resting position as shown by dashed lines, to an active position, as shown by solid lines, in order to begin the winding of a new roll. After winding has been initiated cylinder 128 returns arm 129 and roll 127 to the resting position. Roll 124 is a freewheeling roll with grooves therein for ropes 117 and 123, and provides a return for ropes 117 and 123. Roll 130 is freewheeling, has grooves, and serves as a guide for ropes 119.

Turret assembly 106 includes three spindles 131, 132, and 133. The spindles are mounted on a rotatable turret 135 at substantially equal angles from one another. As shown in FIG. 1, spindle 131 is in the transfer position, spindle 132 is in the winding position, and spindle 133 is in the roll removal position. The operation of turret assembly 106 will be described in greater detail below.

Figure 2:
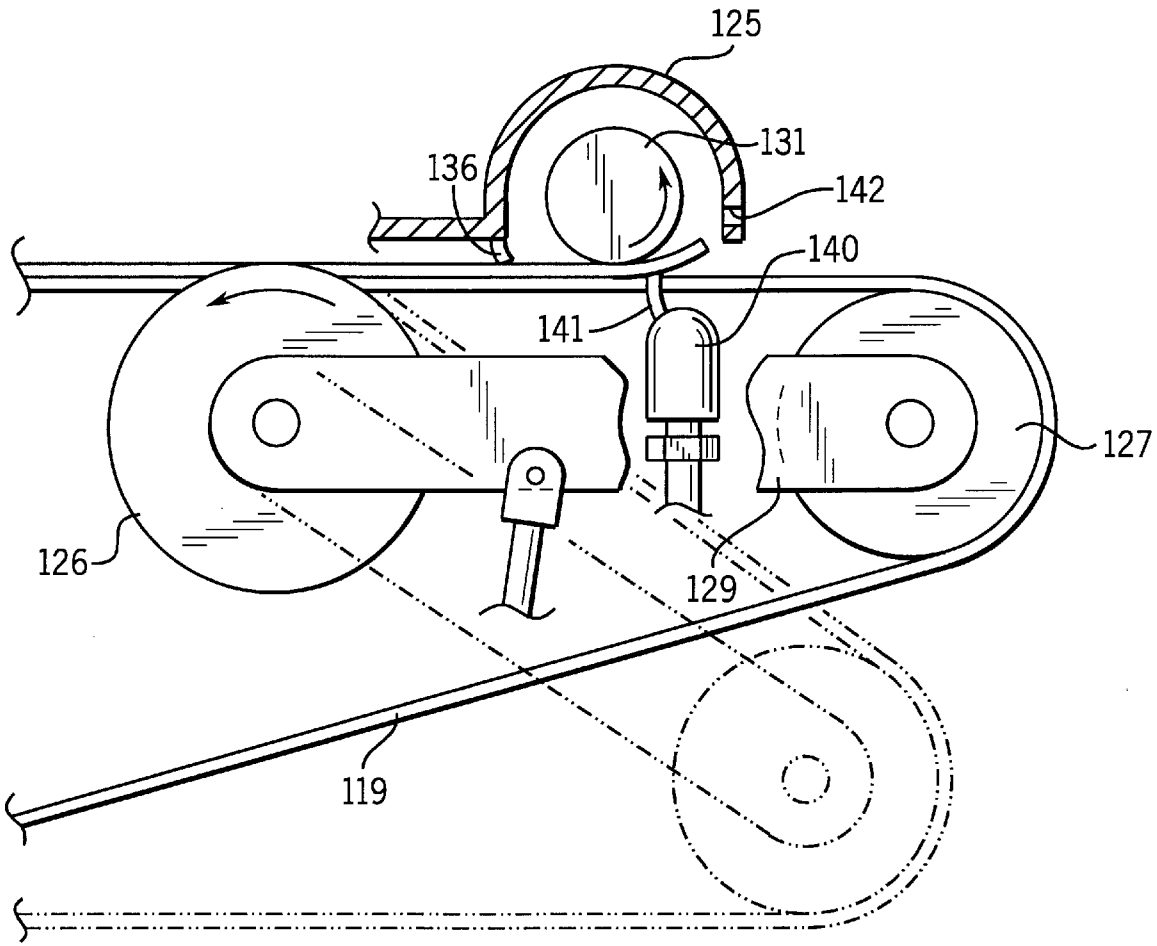
FIG. 2 is a schematic of a transfer system constructed in accordance with the present invention.

Referring now to FIG. 2, transfer assembly 105 is shown in greater detail and further includes a plurality of air nozzles 140 mounted on arm 129, and a plurality of deflectors 141 mounted on arm 129. Also, as may be seen more easily in FIG. 2, rolls 126 and 127 guide rope 119 as it is returned to the upstream portions of winder 100. Both rolls 126 and 127 are freewheeling, and roll 127 serves to return ropes 119 toward roll 112.

As in FIG. 1, the solid lines in FIG. 2 indicate the active position and the dashed lines indicated the resting position. Prior to transferring the leading edge of a strip of film 102 to a new spindle, transfer assembly 105 is in the resting position. At the time a transfer is to be made transfer assembly 105 is moved to the active position as described below.

To effect a transfer, cylinder 128 moves arm 129 upward, prior to the leading edge of film 102 reaching the winding assembly. This causes kick roll 127 to move to the active position. As kick roll 127 moves, the path length of ropes 119 changes slightly. Ropes 119 are slightly elastic to compensate for this change. Also, as arm 129 is raised, air nozzles 140 are moved to the active position, which is immediately below the path of film 102. Deflectors 141 are mounted such that in the active position they extend into the path of film 102. Deflectors 141 are of a size and location to fit between ropes 119.

A very short time after cylinder 128 (not shown on FIG. 2) began moving, and before it has completed moving, airhorn 125 is moved into the active position, over spindle 131, as shown in FIG. 2. At the time the leading edge of film 102 reaches transfer assembly 105 deflectors 141 are in the film path, between the ropes. Also, at this time a blast of air, typically about three to five seconds in duration, is provided by nozzles 140. Thus, deflectors 141 and the air blast deflect the leading edge of film 102 upward, into airhorn 125. In the preferred embodiment nozzles 140 are a plurality of nozzles disposed in a line perpendicular to the direction film 102 travels. In other embodiments the nozzles 140 may be replaced by a single source of pressurized air, other nozzles, and/or the blast of air is provided for other periods of time.

At the same time nozzles 140 provide a blast of air, a plurality of air holes 142 in airhorn 125 also provide a blast of air that directs the leading edge of film 102 around the inside of airhorn 125 into its own nip. To further help direct the leading edge of film 102 a deflector strip 136, comprised of cloth in the preferred embodiment, is provided along the upstream edge of airhorn 125. Cloth 136 helps direct film 102 into its own nip and prevent film 102 from erroneously going back upstream.

Spindle 131 is rotated about its axis at a speed which exceeds that of the film speed so that a tight winding of the inside wraps is accomplished. As soon as the transfer is completed and the leading portion of the strip is secured about spindle 131, airhorn 125 is moved back to the resting position (not shown). In the resting position airhorn 125 is away from spindle 131. After airhorn 125 begins returning to the resting position, cylinder 128 (not shown on FIG. 2) begins moving arm 129, kick roll 127 and nozzles 140 with fingers or deflectors 141 back to their resting positions.

Referring again to FIG. 1, after transfer assembly 105 returns to the resting position, turret 135 is rotated counterclockwise by 120° for a three spindle turret and 90° for a four spindle turret. Thus, spindle 131 moves to the winding position. In this position film 102 continues to be wound about spindle 131. As may be seen, no belt is provided to support the film as it travels from transfer assembly 105 to the final winding position. An idler roll 144 is provided so that it abuts against the film winding on the spindle in the winding position. Roll 144 is connected to a linear potentiometer 145, thus as the roll of film increases in diameter and roll 144 is deflected outward the resistance of potentiometer 145 changes. This is used in the control of the machine, wherein the torque applied to the spindle is increased as the size of the wound roll increases.

When a counter (not shown) indicates that the correct number of bags has been wound on the spindle, the sequencing begins again, i.e., the film is cut, a transfer is made at the transfer station, the turret rotates, etc. At this point, the finished roll on spindle 131 is moved to the removal position. The push-off system includes in one embodiment a geneva-type palm plate (not shown), as is well known in the art. The rolls pushed off the turret 135 may be collected in any suitable manner for packaging in a box or a plastic sleeve. The packaging system may be of any type known to the art and will not be described here.

Numerous modifications may be made to the present invention which still fall within the intended scope hereof. Thus, it should be apparent that there has been provided in accordance with the present invention a method and apparatus for winding bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A method for winding film comprising:

guiding a strip of the film through a winding machine on a plurality of ropes;

rotating a spindle;

moving at least one deflector between the plurality of ropes into contact with the film upstream of an airhorn;

moving the airhorn to the spindle;

directing a leading edge of the strip into the airhorn with the deflector;

directing the leading edge of the strip into its own nip; and winding the strip about the spindle.

2. The method of claim 1 wherein the step of directing the leading edge of the strip into the airhorn further includes directing a blast of air toward the airhorn and between the ropes into the path of the film upstream of the airhorn.

3. The method of claim 1 further including the step of separating a first strip of the film from a second strip of the film.

4. The method of claim 1 further including the step of moving the spindle to a winding position after the strip has been directed into its own nip.

5. The method of claim 1 further including the step of moving the airhorn away from the spindle after the strip has been directed into its own nip.

6. The method of claim 1 further including the step of moving the deflector out of the path of the film after the strip has been directed into its own nip.

7. The method of claim 1 including the step of moving a deflector strip from a resting position to between an upstream edge of the airhorn and the strip.

8. The apparatus of claim 1 further including a rotatable turret, upon which the spindle is mounted.

9. A method for winding film comprising:

guiding a strip of the film through a winding machine on a plurality of ropes;

rotating a spindle;

moving an airhorn to the spindle;

directing a leading edge of the strip into the airhorn by directing a blast of air toward the airhorn and between the ropes and into the path of the film upstream of the airhorn;

moving at least one deflector into contact with the film upstream of the airhorn;

directing the leading edge of the strip into the airhorn and further into its own nip; and winding the strip about the spindle.

10. An apparatus for winding film comprising:

a plurality of ropes for guiding the film;

a pair of haul-in rolls, a rotatable spindle;

at least one deflector mounted on a movable arm, wherein the deflector is moved between the ropes and into contact with the film upstream of the airhorn;

an airhorn, movable to be disposed over the spindle; and a source of air in the airhorn to direct the leading edge of the strip into its own nip.

11. The apparatus of claim 10 including at least one source of air disposed to direct a blast of air toward the airhorn and between the ropes into the path of the film upstream of the airhorn.

12. The apparatus of claim 11 wherein the source of air and the deflector are disposed between the spindle and a downstream edge of the airhorn.

13. The apparatus of claim 10 further including an a pair of interrupt rolls disposed in the path of the film, upstream of the spindle.

14. The apparatus of claim 10 wherein the airhorn is movable between a position adjacent to and a position away from the spindle.

15. The apparatus of claim 10 wherein the deflector is movable between a position in and a position out of the path of the film.

16. The apparatus of claim 10 including a deflector strip attached to the airhorn and disposed upstream of the airhorn.

17. An apparatus for winding film comprising:

a plurality of ropes guiding for guiding the film;

a pair of haul-in rolls;

a rotatable spindle;

at least one source of air disposed to direct a blast of air toward the airhorn and between the ropes and into the path of the film upstream of the airhorn;

at least one deflector mounted on a movable arm, wherein the deflector is disposed in a path of and contacts the film upstream of the airhorn;

an airhorn, movable to be disposed over the spindle; and a source of air in the airhorn wherein the leading edge of the strip is directed into its own nip.

18. A method for transferring film to a spindle mounted on a turret comprising:.

guiding a leading edge of a strip of the film to the spindle on a plurality of ropes;

moving an airhorn to the spindle;

moving at least one deflector between the ropes and into contact with the film upstream of the airhorn, thereby directing the leading edge of the strip into the airhorn;

directing the leading edge of the strip into its own nip; and rotating the spindle, thereby winding the strip about the spindle.

19. The method of claim 18 including the step of blowing air in the path of the film so as to deflect the leading edge of the film into the airhorn.

20. The method of claim 18 including the step of placing a deflector strip between an upstream edge of the airhorn and the film.

21. The method of claim 18 including the step of moving the spindle to a winding position after the step of directing the strip into its own nip.

22. The method of claim 18 including the step of moving a deflector strip from a resting position to an active position between an upstream edge of the airhorn and the film.

23. The method of claim 18 including the steps of moving the airhorn, deflector and deflector strip to resting positions.

24. A method for transferring film to a spindle mounted on a turret comprising:

guiding a leading edge of a strip of the film to the spindle on a plurality of ropes;

moving an airhorn to the spindle;

blowing air toward the airhorn and between the ropes and into the path of the film upstream of the airhorn, thereby directing the leading edge of the strip into the airhorn;

moving at least one deflector into contact with the film upstream of the airhorn;

directing the leading edge of the strip into its own nip within the airhorn; and rotating the spindle, thereby winding the strip about the spindle.

25. An apparatus for transferring film comprising:

a plurality of ropes to guide the film;

a rotatable spindle mounted on a turret;

an airhorn, disposed to be movable to the spindle; and at least one deflector, mounted to be movable between the ropes and into contact with the film upstream of the airhorn.

26. The apparatus of claim 25 including at least one source of air disposed to blow air toward the airhorn and between the ropes into the path of the film so as to deflect a leading edge of the film into the airhorn.

27. The apparatus of claim 25 including a deflector strip mounted on an upstream edge of the airhorn.

28. The apparatus of claim 25 wherein the turret is rotatable.

29. An apparatus for transferring film moving along a path comprising:

a plurality of ropes guiding for guiding the film;

a rotatable spindle mounted on a turret;

at least one deflector mounted to be movable into the path of the film downstream of the spindle;

an airhorn, disposed to be movable to the spindle; and at least one source of air disposed to blow air toward the airhorn and between the ropes and into a path of the film.

* * * * *